United States Patent [19]

Walborn

[11] 3,999,222

[45] Dec. 28, 1976

[54] NECKTIE KNOT SIMULATOR

[76] Inventor: Luther C. Walborn, 1333 E. Butler, Phoenix, Ariz. 85020

[22] Filed: Mar. 18, 1976

[21] Appl. No.: 668,233

[52] U.S. Cl. ..... 2/150

[51] Int. Cl.[2] ..... A41D 25/02

[58] Field of Search ..... 2/148, 150, 149, 152 R, 2/153

[56] References Cited

UNITED STATES PATENTS

| | | | |
|---|---|---|---|
| 982,948 | 1/1911 | Griesemer | 2/150 |
| 1,959,801 | 5/1934 | Scharlin | 2/150 |
| 2,553,437 | 5/1951 | Burke | 2/150 |
| 3,060,448 | 10/1962 | Mongelli | 2/150 |

*Primary Examiner*—G. V. Larkin

*Attorney, Agent, or Firm*—Drummond, Nelson & Ptak

[57] ABSTRACT

A knot simulator for a four-in-hand necktie includes a panel generally shaped, contoured and dimensioned to correspond to the front and side surfaces of a four-in-hand necktie knot and clamp means on the rear of the panel for engaging the free ends of the necktie close to the wearer's collar, to fix the free ends in normal overlapping downwardly extending relationship without tying a knot.

1 Claim, 13 Drawing Figures

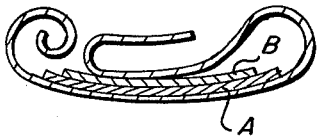
FIG-10
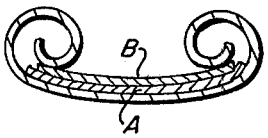
FIG-11
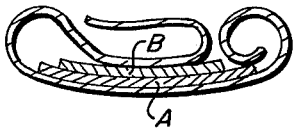
FIG-12
FIG-13
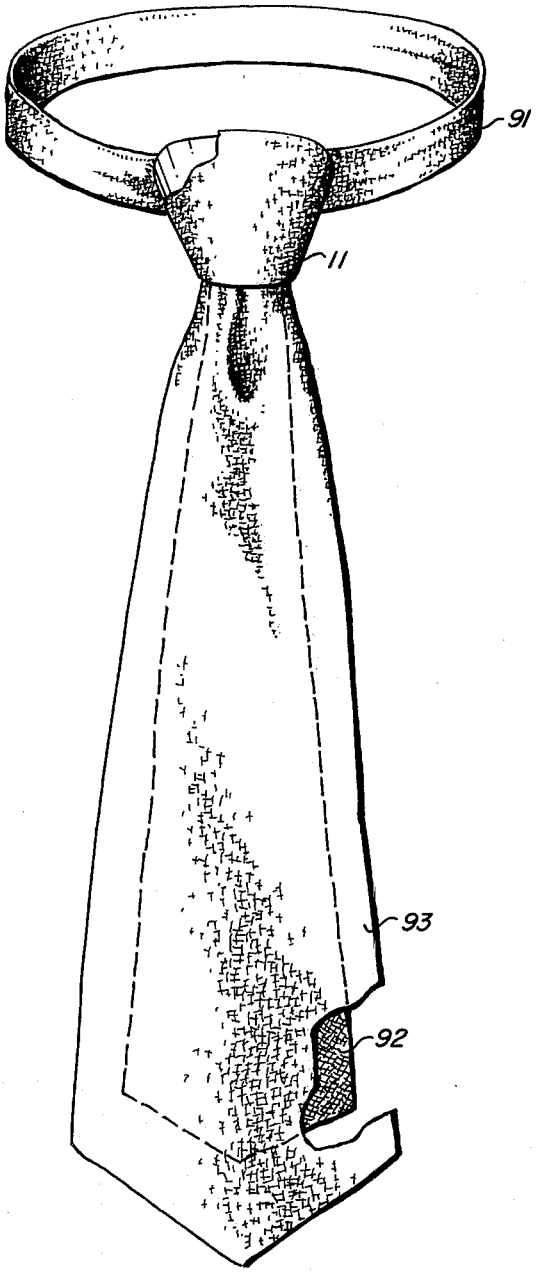

NECKTIE KNOT SIMULATOR

My invention relates to a knot simulator for a four-in-hand necktie.

More specifically, the invention concerns a knot simulator which enables the wearer to arrange a four-in-hand necktie in normal wearing position without tying a knot therein.

In still another respect, the invention concerns a knot simulator which can be quickly and conveniently applied to a four-in-hand necktie to allow the necktie to be worn in its normal position without tying a knot and without subjecting the tie to wear and wrinkling normally induced by tying a conventional four-in-hand knot.

Tying a knot in a four-in-hand tie requires some minimal skill, is often bothersome and time-consuming and, in addition, when repeated many times, often results in wear and/or wrinkling of the tie, especially when the tie is fabricated from certain materials, such as silk.

Tying a knot in a tie having a non-repetitive or intricate pattern is especially difficult since the free ends of the tie must be arranged rather precisely before tying the knot so that the knot will not interrupt the pattern in an aesthetically unpleasing manner.

Accordingly, it would be advantageous to provide a simple means for simulating the appearance of a normal four-in-hand necktie knot without performing the normal complicated manipulative steps of actually tying the knot and by means which do not result in undue wear or wrinkling of the tie. It would be especially advantageous to provide a knot simulator which can be quickly and conveniently applied to a four-in-hand necktie in such manner that the free ends of the tie can be positioned properly so as to avoid mislocating an intricate or non-repetitive pattern of the necktie fabric.

It is therefore a principal object of the present invention to provide a knot simulator for a four-in-hand necktie.

Another object of the invention is to provide a knot simulator device which can be quickly and conveniently applied to the tie while avoiding the delays and frustrations sometimes encountered in tying such a necktie in the proper fashion.

It is yet another object of the invention to provide a knot simulator which, when applied, positions the free ends of a four-in-hand necktie in the correct overlapping relationship while avoiding undue wear or wrinkling of the tie or disruption of the pattern of the fabric.

These and other, further and more specific objects and advantages of the invention will become apparent from the following detailed description thereof, taken in conjunction with the drawings, in which:

FIG. 10 is a cross-sectional view of the knot simulator of FIG. 2, taken along section line 10—10 thereof and illustrating the manner in which the simulator grips and locates the portions of the free ends of the necktie in accordance with the invention;

FIG. 11 is a cross-sectional view of the knot simulator of FIG. 3, taken along section line 11—11 thereof and illustrating the manner in which the simulator grips and locates the portions of the free ends of the necktie in accordance with the invention;

Figure 6:
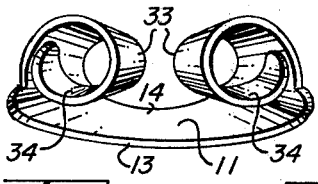
FIG. 6 is a top view of the simulator of FIG. 3.
Figure 7:
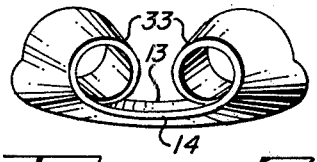
FIG. 7 is a bottom view of the simulator of FIG. 3.
Figure 8:
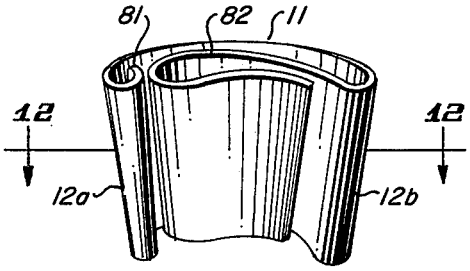
FIG. 8 is a rear view of a knot simulator incorporating yet another embodiment of the invention.

FIG. 12 is a cross-sectional view of the knot simulator of FIG. 8, taken along section line 12—12 thereof and illustrating the manner in which the simulator grips and locates the portions of the free ends of the necktie in accordance with the invention; and FIG. 13 is a perspective view of a four-in-hand necktie formed in normal wearing position by the use of a knot simulator constructed in accordance with any of FIGS. 1–12.

Briefly, in accordance with my invention, I provide a knot simulator for a four-in-hand necktie. The term "four-in-hand necktie" is used herein in the conventional sense to describe a necktie comprising an elongate strip of fabric which is normally worn by wrapping a portion of the necktie which is intermediate the free ends thereof around the wearer's neck, under his shirt collar. Normally, a knot is then formed in the shape of an inverted, truncated triangle by tying the portions of the free ends of the necktie which extend just past the wearer's collar in various special ways to form the knot snugly at the wearer's throat, allowing the free ends to extend downwardly therefrom in overlapped relationship.

The knot simulator provided in accordance with this invention comprises a panel member having front and side surfaces, which is generally shaped, contoured and dimensioned to correspond to the front and side surfaces of a conventional four-in-hand necktie knot and tie-clamping means operatively associated with the rear of the panel members. The tie-clamping means are adapted to receive, engage and overlie those portions of the free ends of the necktie which extend just past the wearer's collar in such manner that the engaged portions are fixed in normal overlapping relationship, with the overlapped free ends of the necktie extending downwardly therefrom, thus achieving the appearance of a normally tied four-in-hand necktie, without tying a knot therein.

Figure 1:
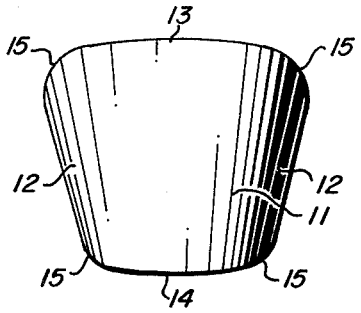
FIG. 1 is a front view of a necktie knot simulator embodying the present invention and generally depicts the front and side appearances of a simulator device of the various separate embodiments of the invention illustrated in the remaining figures.

Referring now to the drawings, FIG. 1 depicts the general shape and contours of the front panel of the various embodiments of the necktie simulator shown in the remaining views, and consists of a front surface 11, rounded and rearwardly curved side surfaces 12, an upper edge 13 and a lower edge 14. It will be noted that the panel is generally in the form of an inverted, truncated triangle with the corners 15 rounded to achieve the general appearance of a neatly and correctly tied four-in-hand necktie knot.

Figure 2:
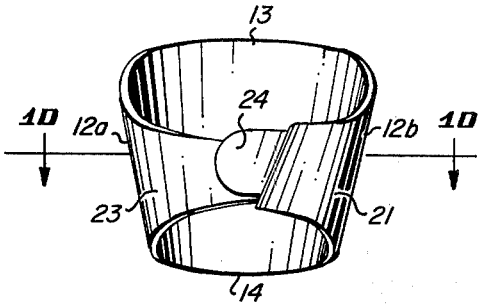
FIG. 2 is a rear view of one embodiment of a necktie knot simulator incorporating the present invention.
Figure 3:
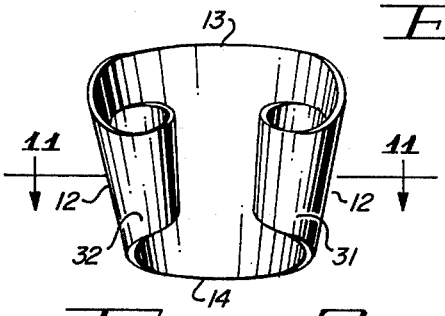
FIG. 3 is a rear view of the preferred embodiment of a necktie knot simulator incorporating the present invention.

As shown in FIGS. 2, 3 and 8, the rearwardly extending portions of the front panel 1 can then be formed into a variety of tie-clamping means. For example, FIGS. 2 and 4–5 illustrate one embodiment in which one of the rearwardly extending curved extensions 21 of the side surfaces 12*a* is formed into a relatively tight loop 22 and the other rearwardly extending curved extension 23 of the opposite side surfaces 12*b* is bent inwardly toward the front panel 11, extends across the rear of the front panel 11 to a point proximate the tight loop 22 and is then bent back on itself to form a tongue member 24.

In the preferred embodiment of the invention, as illustrated in FIGS. 3 and 6–7, each of the opposite rearwardly extending curved extensions 31 and 32 of the curved side surfaces 12 is bent back on itself to form a relatively tight loop 33, the tongue portions 34 of which are spaced or can be sprung to a position close to the rear of the panel member 11.

Figure 9:
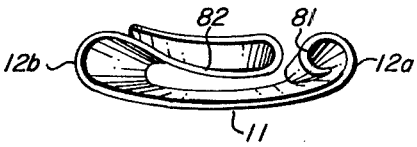
FIG. 9 is a bottom view of the knot simulator of FIG. 8.

Yet another embodiment of the invention is illustrated in FIGS. 8–9, in which one of the curved side surfaces 12*a* is formed into a tight loop 81 to form an edge for the panel 11 having substantial thickness and curvature, and the opposite curved side surface 12*b* is formed into a long loop 82 which extends practically all of the way across the rear of the panel 11 to a point which is spaced or can be sprung to a position close to the tight loop 81.

Figure 4:
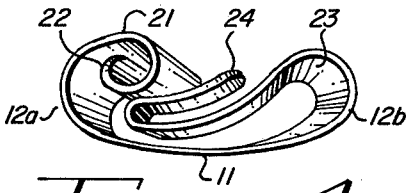
FIG. 4 is a top view of the simulator of FIG. 2.
Figure 5:
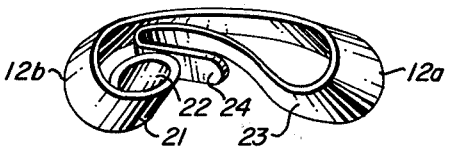
FIG. 5 is a bottom view of the simulator of FIG. 2.

As will be apparent to those skilled in the art, the embodiments illustrated in FIGS. 1–9 can be utilized to hold the free ends of the four-in-hand tie proximate the wearer's neck in overlapped relationship, as shown in FIGS. 10–12, wherein the overlapped portions of the necktie are identified by the reference characters A and B, and wherein FIG. 10 illustrates the embodiment of FIGS. 2 and 4–5; FIG. 11 illustrates the preferred embodiment of FIGS. 3 and 5–6; and FIG. 12 illustrates the embodiment of FIGS. 8–9.

Finally, FIG. 13 illustrates the appearance of a four-in-hand necktie positioned for wearing by use of any of the embodiments of FIGS. 1–9 and depicts the intermediate portion 91 of the necktie which encircles the wearer's neck and the overlapped free ends 92 and 93 of the necktie which are positioned in overlapping downwardly extending relationship by the knot simulator 11 in any one of the manners illustrated in FIGS. 10–12.

As will be apparent to those skilled in the art, the necktie knot simulators of this invention can be formed of practically any suitable material, such as metal, plastic or the like. The knot simulator devices may even be covered with fabric of the same or a different color or pattern than the necktie with which they are used. Of course, the knot simulators can be fabricated from precious or semi-precious metals, such as silver, gold alloys, etc., and can bear distinctive emblems or other decorations on the front surfaces thereof to provide a wide variety of interesting and aesthetically appealing effects.

Having described my invention in sucn full, clear, concise and exact terms as to enable those skilled in the art to which it pertains to understand and use it, and having identified the presently preferred embodiment thereof, I claim:

1. A knot simulator for a four-in-hand necktie, which necktie comprises an elongate strip of fabric which is normally worn by wrapping a portion of the necktie intermediate the free ends thereof around the wearer's neck under the collar of his shirt, forming a knot in the general shape of an inverted, truncated triangle in the portions of the free ends of said necktie extending just past the wearer's collar, allowing said free ends to extend downwardly therefrom in overlapped relationship, said knot simulator comprising:

a. a panel member having front, side and rear surfaces, generally shaped, contoured and dimensioned such that said front and side surfaces correspond to and simulate front and side surfaces of a four-in-hand necktie knot, and b. tie clamping means formed integrally as inwardly curved extensions of the sides of said panel member, said extensions being adapted to receive, and clampingly engage between said extensions and the rear surface of said panel member those portions of the free ends of said necktie which extend just past the wearer's collar, to fix said engaged portions in normal overlapping relationship, with the overlapped free ends of said necktie extending downwardly therefrom, without tying a knot therein.

* * * * *